United States Patent [19]

Moskin

[11] Patent Number: 4,678,985

[45] Date of Patent: Jul. 7, 1987

[54] TWO-TERMINAL LINE-POWERED CONTROL CIRCUIT

[75] Inventor: Jeffrey M. Moskin, Los Angeles, Calif.

[73] Assignee: Novitas, Inc., Santa Monica, Calif.

[21] Appl. No.: 925,607

[22] Filed: Oct. 31, 1986

[51] Int. Cl.[4] ..... G05F 3/02

[52] U.S. Cl. ..... 323/324; 307/632; 315/156; 315/208

[58] Field of Search ..... 323/324; 307/252 B, 307/252 P; 315/363, 208, 156, 159, 287

[56] References Cited

U.S. PATENT DOCUMENTS 4,331,914 5/1982 Huber ..... 307/252 B 4,334,183 6/1982 Havenstein ..... 307/252 B 4,334,184 6/1982 Havenstein ..... 307/252 B

*Primary Examiner*—William H. Beha, Jr.

*Attorney, Agent, or Firm*—Karon, Morrison & Savikas

[57] ABSTRACT

A two-terminal line-powered control circuit is disclosed in which a triac is used to switch AC power to a load. When the triac is not conducting, a portion of the voltage appearing across it is rectified and filtered and used to supply power to a radio control circuit. When the triac is conducting, the voltage appearing across inverse-parallel connected diodes, which are in series with the triac, is stepped-up using a transformer, then rectified and filtered and used to supply power to the radio control circuit. The radio control circuit is in turn used to control the operation of the triac in response to a remotely transmitted radio signal.

5 Claims, 1 Drawing Figure

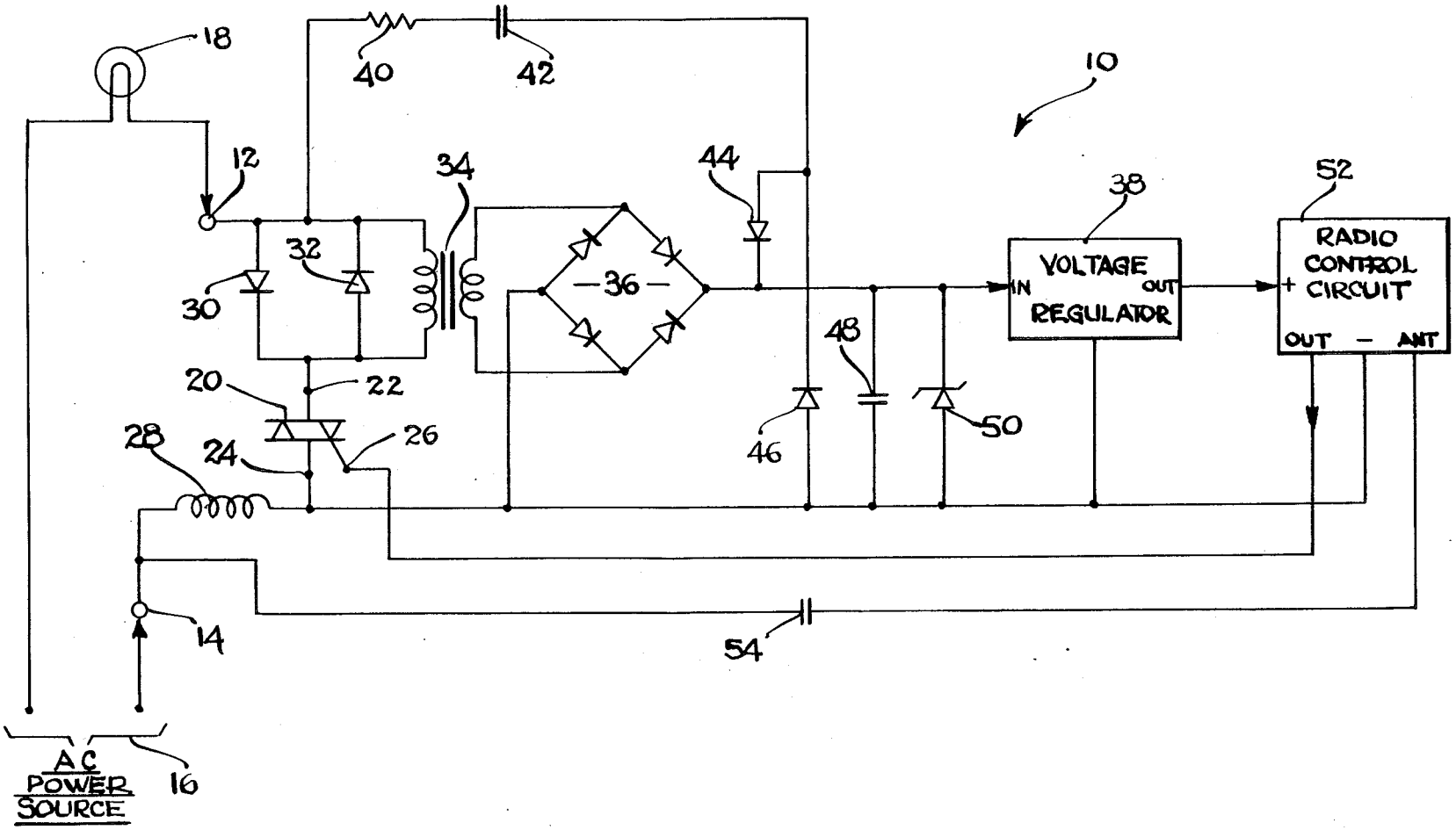
RADIO CONTROL CIRCUIT
+
OUT
−
ANT
VOLTAGE REGULATOR
IN
OUT
10
12
14
16
18
20
22
24
26
28
30
32
34
36
38
40
42
44
46
48
50
52
54
A.C. POWER SOURCE

TWO-TERMINAL LINE-POWERED CONTROL CIRCUIT

BACKGROUND OF THE INVENTION

This invention relates to control circuits and, more particularly, to two-terminal line-powered control circuits.

A recent application for electronic control circuits is the remote actuation of residential lights using radio control signals. In such applications, it is desirable to be able to directly replace the conventional wall-mounted light switch with a module containing circuitry capable of receiving a radio signal and actuating the light in response thereto.

A problem inherent in the design of a control circuit for the above described application is that, conventionally, the wiring to the light switch is limited to two wires which, when connected together, complete the circuit between the light and the power line. In this configuration, there is no direct access to both sides of the power line to provide continuous power to operate the control circuitry. One solution to the above stated problem is to rewire the light circuit to provide access to both sides of the power line at the light switch. Another solution is to provide batteries to operate the control circuitry. Both of these solutions complicate the design and installation of such circuits and are expensive to implement.

Accordingly, it is an object of the present invention to provide a new and improved control circuit.

It is another object of the present invention to provide a new control circuit having only two terminals which may be connected in series between a power line and a load for remote control of the load.

SUMMARY OF THE INVENTION

The foregoing and other objects of the invention are accomplished by a control circuit which includes a bidirectional switch, such as a triac, having first and second main terminals, and a control terminal used for triggering the switch into conduction.

Connected in series with the switch are a pair of diodes which are connected to each other in an inverse parallel arrangement to allow bidirectional current flow. The diodes act to maintain a relatively constant voltage drop across them over a wide range of current passing through them. The switch in combination with the diodes forms a first series circuit, whereby a bidirectional current path is established through this series circuit when the switch is triggered into conduction.

First and second circuit terminals are provided which are connected to a load circuit comprising a load in series with an AC power source whereby, when the bidirectional current path is established, the load is energized by the power source.

A transformer is provided having a primary and a secondary winding, and the primary winding is connected in parallel with the inverse-parallel connected diodes. The AC terminals of a full-wave bridge rectifier are connected to the transformer secondary winding. One of the DC terminals of the bridge is connected to a first end of the first series circuit. A current limiter in series with a diode rectifier is connected between the second end of the first series circuit and the other one of the DC terminals of the bridge. A filter capacitor is connected across the DC terminals of the bridge.

A controller is provided for generating a control signal which is applied to the switch control terminal to trigger the switch into conduction. The controller is connected to the DC terminals of the bridge from which the controller derives its operating power.

Other objects, features and advantages of the invention will become apparent by reference to the specification taken in conjunction with the drawing.

BRIEF DESCRIPTION OF THE DRAWING

The sole FIGURE is a schematic/block diagram of a control circuit constructed in accordance with the invention.

DESCRIPTION OF THE PREFERRED EMBODIMENT

Referring to the FIGURE, there is shown a schematic diagram of the circuit 10 of the present invention. The circuit 10 includes a pair of terminals 12, 14 which are connected in series with a source of AC voltage 16 to be controlled, and a load 18 (e.g. a lamp) to which the voltage is to be applied. A function of the circuit in the FIGURE is to apply and remove power to the load 18 in response to externally generated radio control signals provided by, for example, a remote hand-held radio transmitter (not shown).

The bidirectional power switching device used in the circuit is, preferably, a triac 20 having main terminals 22 and 24, and a gate terminal 26. The terminal 24 is connected to circuit terminal 14 through inductor 28 which acts as an RF choke, in a manner well known to those skilled in the art, to suppress interference generated by the triac 20. The main terminal 22 is connected to the cathode of rectifier diode 30 and the anode of rectifier diode 32. The remaining terminals of the diodes 30, 32 are connected to the circuit terminal 12.

The diodes 30, 32, which are connected in an inverse-parallel configuration, act to provide a relatively constant AC voltage drop of about one volt over a wide range of load current flowing through the triac 20. The voltage drop across the diodes 30, 32 is substantially negligible compared to the AC voltage from the source 16. Accordingly, when the triac 20 conducts, substantially all of the AC source voltage is delivered to the load 18. Rather than using two separate diodes 30, 32 to accomplish this function, it is possible to utilize a single triac having its gate terminal connected through a low value resistor to a main terminal such that the triac is always biased into bidirectional conduction.

A primary winding of a transformer 34 is connected in parallel with the diodes 30, 32. A secondary winding of the transformer 34 is connected to the AC terminals of a full-wave bridge rectifier 36. The negative DC terminal of the bridge 36 is connected to main terminal 24 of the triac 20. The positive DC terminal of the bridge 36 is connected to an input terminal of a voltage regulator 38, the ground terminal of which is connected to the main terminal 24 of the triac 20.

An AC current limiting circuit, comprising a resistor 40 in series with capacitor 42, is connected between the circuit terminal 12 and the anode of a rectifier diode 44. The cathode of the diode 44 is connected to the positive DC terminal of the bridge 36. The anode of a second rectifier diode 46 is connected to the triac terminal 24, and the cathode of this diode is connected to the anode of the diode 44.

A filter capacitor 48 and a zener diode voltage regulator 50 are connected in parallel across the DC terminals of the bridge 36.

The positive and negative operating voltage terminals of a radio control circuit 52 are connected to the output and ground terminals, respectively, of the circuit 52. An output terminal of the circuit 52 is connected to the gate terminal 26 of the triac 20, and an antenna terminal of the control circuit 52 is connected through a line isolation capacitor 54 to the circuit terminal 14.

The radio control circuit 52 acts to provide a control signal at its output terminal, suitable for triggering the triac 20 into conduction, in response to an RF signal appearing at the circuit 52 antenna terminal. The antenna terminal is coupled through isolation capacitor 54 to the AC lines, which act as an antenna to receive RF signals generated by, for example, a portable hand-held transmitter (not shown).

The operation of the circuit 10 is as follows. In a preferred embodiment, the circuit 10 is designed to be installed in place of an existing wall switch to control one or more lights 18. Thus terminals 12 and 14 are connected to the wires which normally connect to the wall switch. With the triac 20 in the non-conducting state, essentially all of the AC voltage from source 16 appears across terminals 12 and 14.

During positive half cycles of the AC voltage, current flows through resistor 40, capacitor 42, and diode 44, and charges capacitor 48 to a voltage determined by the value of the zener diode 50. During negative half cycles of the AC voltage, current flows through clamp diode 46, capacitor 42, and resistor 40. The purpose of diode 46 is to provide AC current through current limiting capacitor 42 so that it does not acquire a DC charge. In the event that only a resistor is used as the current limiting element, the diode 46 is not necessary.

The values of the capacitor 42 and resistor 40 are such that the current flowing through them is less than the current required to energize the light 18.

The DC voltage appearing across capacitor 48 is regulated by regulators 50 and 38 and supplied as operating voltage to the radio control circuit 52. In the absence of an RF signal at the antenna terminal of circuit 52, no control signal is provided at the gate 26 of triac 20, and it remains non-conducting. Thus, the light 18 remains de-energized.

When a suitable RF signal is provided (by, for example, a remote transmitter), the control circuit 52 triggers the triac 20 into conduction. Under this condition, the voltage drop across the circuit terminals 12 and 14 falls to a few volts i.e. the conducting voltage drop across the triac 20 in series with the voltage drop across the diodes 30, 32.

With the triac 20 in conduction, there is insufficient voltage across the terminals 12, 14 to provide operating power to the circuit 52 through current limiter elements 40, 42. Instead, operating power is derived from the voltage drop appearing across the diodes 30, 32.

The AC current flowing through the load 18 when the triac 20 is conducting provides an AC voltage drop of about one volt across the diodes 30, 32. This voltage is stepped up by the action of transformer 34 to a voltage level suitable for operating the circuit 52 (e.g. 10 volts).

The stepped-up AC voltage appearing across the transformer secondary is rectified by bridge 36 and applied to the filter capacitor 48, zener diode 50 and voltage regulator 38. The resultant filtered and regulated voltage is provided as operating power to the control circuit 52.

From the above description, it may be seen that the two-terminal circuit 10 provides operating power to the control circuit 52 regardless of whether the triac 20 is conducting or non-conducting.

While the invention is disclosed and a particular embodiment is described in detail, it is not intended that the invention be limited solely to this embodiment. Many modifications will occur to those skilled in the art which are within the spirit and scope of the invention. It is thus intended that the invention be limited in scope only by the appended claims.

What is claimed is:

1. A control circuit comprising in combination:

bidirectional switch means having first and second main terminals and a control terminal used for triggering the switch means into conduction;

bidirectional voltage regulator means for maintaining a relatively constant voltage drop across said means over a wide range of current passing through said means in either direction;

means for connecting the bidirectional switch means in series with the bidirectional voltage regulator means to form a first series circuit whereby a bidirectional current path is established through the first series circuit when the switch means is triggered into conduction;

first and second circuit terminals;

means for connecting the circuit terminals to a load circuit which includes a load connected in series with an AC power source;

means for connecting the first series circuit to the circuit terminals, whereby when the bidirectional current path is established, the load is energized by the power source;

transformer means having a primary and a secondary winding;

first rectifier means;

means for connecting the primary winding of the transformer in parallel with the bidirectional voltage regulator means;

means for connecting the first rectifier means to the transformer secondary winding to rectify the voltage appearing across said winding, said rectified voltage appearing at a first pair of rectified voltage terminals when the switch means is conducting;

second rectifier means;

current limiter means;

means for connecting the current limiter means and the second rectifier means to the two circuit terminals to provide a current limited and rectified voltage to a second pair of rectified voltage terminals in response to the voltage appearing across the circuit terminals when the switch means is not conducting;

means for connecting the first pair of rectified voltage terminals in parallel with the second pair of rectified voltage terminals;

energy storage means;

means for connecting the energy storage means to the first pair of rectified voltage terminals to filter the rectified voltage appearing thereacross;

controller means for providing a control signal;

means for connecting the controller means to the control terminal of the switch means whereby the control signal acts to trigger the switch means into conduction; and means for connecting the controller means to the energy storage means, whereby the controller means derives its operating power from the filtered rectified voltage.

2. The control circuit of claim 1 in which the bidirectional voltage regulator means includes a pair of inverse-parallel, connected diodes.

3. The control circuit of claim 1 in which the first rectifier means includes a full wave bridge.

4. The control circuit of claim 1 in which the current limiter means includes a resistor in series with a capacitor.

5. The control circuit of claim 1 in which the bidirectional voltage regulator means includes a triac biased into bidirectional conduction.

* * * * *